US008312925B2

(12) United States Patent
Trummer et al.

(10) Patent No.: US 8,312,925 B2
(45) Date of Patent: Nov. 20, 2012

(54) BOTTOM HOLE ASSEMBLY FOR WELLBORE OPERATIONS

(75) Inventors: Sascha Trummer, Sugar Land, TX (US); Douglas Pipchuk, Calgary (CA)

(73) Assignee: Schlumberger Technology Corporation, Sugar Land, TX (US)

( * ) Notice: Subject to any disclaimer, the term of this patent is extended or adjusted under 35 U.S.C. 154(b) by 296 days.

(21) Appl. No.: 12/698,212

(22) Filed: Feb. 2, 2010

(65) Prior Publication Data

US 2010/0200226 A1 Aug. 12, 2010

Related U.S. Application Data

(60) Provisional application No. 61/149,082, filed on Feb. 2, 2009.

(51) Int. Cl.
*E21B 47/09* (2012.01)
*E21B 33/13* (2006.01)

(52) U.S. Cl. ..... 166/278; 166/298; 166/177.5

(58) Field of Classification Search ..... 166/278, 166/297, 298, 308.1, 177.5
See application file for complete search history.

(56) References Cited

U.S. PATENT DOCUMENTS

| | | | | |
|---|---|---|---|---|
| 3,177,941 | A | 4/1965 | Conrad | |
| 3,344,862 | A | 10/1967 | Conrad | |
| 3,902,361 | A | 9/1975 | Watson | |
| 7,278,486 | B2 * | 10/2007 | Alba et al. | 166/308.1 |
| 7,963,332 | B2 * | 6/2011 | Dotson et al. | 166/298 |
| 2005/0178551 | A1 | 8/2005 | Tolman et al. | |
| 2006/0289172 | A1 | 12/2006 | Miller et al. | |
| 2008/0110622 | A1 * | 5/2008 | Willett et al. | 166/280.2 |

* cited by examiner

*Primary Examiner* — William P Neuder
(74) *Attorney, Agent, or Firm* — Michael Flynn

(57) ABSTRACT

An embodiment of a method of performing a wellbore operation in an oilfield comprises providing a bottom hole assembly on a conveyance, deploying the bottom hole assembly into the wellbore with the conveyance, determining the depth location of the bottomhole assembly in the wellbore utilizing a mechanical device, moving the bottom hole assembly to a desired location based on the determined depth, circulating a fluid from the oilfield to the bottomhole assembly, and performing at least one wellbore operation while the bottomhole assembly is deployed at the desired location.

19 Claims, 7 Drawing Sheets

BOTTOM HOLE ASSEMBLY FOR WELLBORE OPERATIONS

CROSS REFERENCE TO RELATED APPLICATIONS

This application claims priority under 35 U.S.C. §119(e) to U.S. Provisional Application Ser. No. 61/149,082, entitled Process For Depth Correlation and Wellbore Circulation During Abrasive Jetting and Fracturing Operations filed on Feb. 2, 2009, the disclosure of which is incorporated herein by reference in its entirety.

FIELD

The present disclosure relates generally to a process for depth correlation and wellbore circulation during abrasive jetting and fracturing operations. In addition, this process can also be applied to conventional cleanouts and fluid/debris circulation.

BACKGROUND

Over the last few decades the utilization of abrasive jetting to create perforations in a subterranean wellbore has increased significantly. More recently the introduction of coiled tubing as a conduit means of the abrasive slurry (as opposed to jointed pipes) has allowed for faster interventions. In order to improve the efficiency on these jobs the requirements have changed and allowed for fracturing a formation with the coiled tubing remaining in the hole while the slurry is pumped to the formation through the annulus between the coiled tubing or jointed pipe and the tubing or casing.

This process was further improved by separating the fracturing stages of a formation with a plurality of pay zones with the placement of a sand plug at the end of the previous fracturing stage, which was never a precise science and could often result in a sand plug being higher or lower than the intended final plug height. This high plug prevents the next stage from being jetted and pumped without performing a remedial operation to adjust the sand plug height. The ability to circulate this sand plug (or the excess of it) with coiled tubing was further enhanced by the use of a reverse circulation valve as part of the coiled tubing bottom hole assembly (BHA), which allows for reverse circulation of the excess sand, or the placement of a new extra sand plug. In some cases, this procedure disadvantageously requires tripping the coiled tubing out of the hole for replacing the BHA with one that allowed that kind of circulation.

At the same time, there were some challenges in regards to depth correlation with coiled tubing and the abrasive jetting nozzle depth, due to stretching and shrinking of the coiled tubing due to several downhole parameters such as temperature, pressure, deviation, and friction, among others, that made the depth control of the nozzle depth very imprecise, which could possibly yield to jetting at the wrong depths. This depth correlation issue has been addressed differently by the industry, initially with correlation runs (running the coiled tubing in hole and pulling out of hole to verify depth) using some sort of correlation device (such as electronic memory casing collar locators, nipple locators or tubing end locators, real-time depth correlation devices based on pumping pressures being choked at the presence of each collar), or in some instances a mechanical device for casing collar location was used during the treatment that would require such item to be placed below the perforations as its external diameter would be very close to the tubing or casing inner diameter and would not allow for fracturing fluid around and/or past it, posing a threat to having the coiled tubing BHA stuck in the hole with proppant packed around the locating device. In general the industry does not have a solution for the depth control and for the wellbore circulation problem in a single trip in the hole.

It is desirable to provide an improved process for depth correlation and wellbore circulation during abrasive jetting and fracturing operations.

SUMMARY

An embodiment of a method of performing a wellbore operation in an oilfield comprises providing a bottom hole assembly on a conveyance, deploying the bottom hole assembly into the wellbore with the conveyance, determining the depth location of the bottomhole assembly in the wellbore utilizing a mechanical device, moving the bottom hole assembly to a desired location based on the determined depth, circulating a fluid from the oilfield to the bottomhole assembly, and performing at least one wellbore operation while the bottomhole assembly is deployed at the desired location. In an embodiment, providing comprises providing a bottom hole assembly on coiled tubing. In an embodiment, providing comprises providing a bottom hole assembly on jointed pipe. In an embodiment, providing further comprises providing a bottom hole assembly comprising a mechanical casing collar locator. Determining the location may comprise determining a depth in the wellbore by use of the mechanical casing collar locator. Providing may further comprise providing a bottom hole assembly comprising a circulation valve.

In an embodiment, providing further comprises providing a bottom hole assembly comprising a circulation valve. In an embodiment, performing at least one wellbore operation comprises circulating a treatment fluid past the mechanical device. In an embodiment, performing comprises forming a sand plug in the wellbore. In an embodiment, performing comprises performing an abrasive jetting operation. In an embodiment, circulating comprises actively selecting the flowpath of the pumped fluid through the different flowpaths in the bottom hole assembly. In an embodiment, circulating comprises circulating fluid from the oilfield past the bottomhole assembly.

An embodiment of a method of performing a wellbore operation comprises providing a bottom hole assembly on a conveyance, the bottom hole assembly comprising a mechanical casing collar locator, a circulation valve, and a cleanout nozzle, deploying the bottom hole assembly into the wellbore with the conveyance, determining the depth location of the bottomhole assembly in the wellbore utilizing a mechanical casing collar locator, moving the bottom hole assembly to a desired location based on the determined depth, circulating a fluid from the oilfield to the bottomhole assembly, and performing at least one wellbore operation while the bottomhole assembly is deployed at the desired location.

In an embodiment, performing at least one wellbore operation comprises circulating a fracturing fluid at fracturing rates past the mechanical device. In an embodiment, performing comprises forming a sand plug in the wellbore. In an embodiment, performing comprises performing an abrasive jetting operation. In an embodiment, performing comprises performing a cleanout operation.

An embodiment of a bottom hole assembly for performing a wellbore operation comprises a mechanical casing collar locator, and at least one nozzle for performing at least one wellbore operation while the bottomhole assembly is deployed at a desired location in the wellbore in a single trip operation. In an embodiment, the assembly further comprising a circulation valve operable to determine a flowpath for treatment fluid within the bottom hole assembly. In an embodiment, the at least one nozzle comprises a jetting nozzle. In an embodiment, the assembly is deployed into a wellbore on coiled tubing. In an embodiment, the mechanical casing collar locator is operable to allow treatment fluid to flow therepast. In an embodiment, the treatment fluid is flowed at fracturing rates past the mechanical casing collar locator.

BRIEF DESCRIPTION OF THE DRAWINGS

These and other features and advantages of the present invention will be better understood by reference to the following detailed description when considered in conjunction with the accompanying drawings wherein.

DETAILED DESCRIPTION

Figure 1:
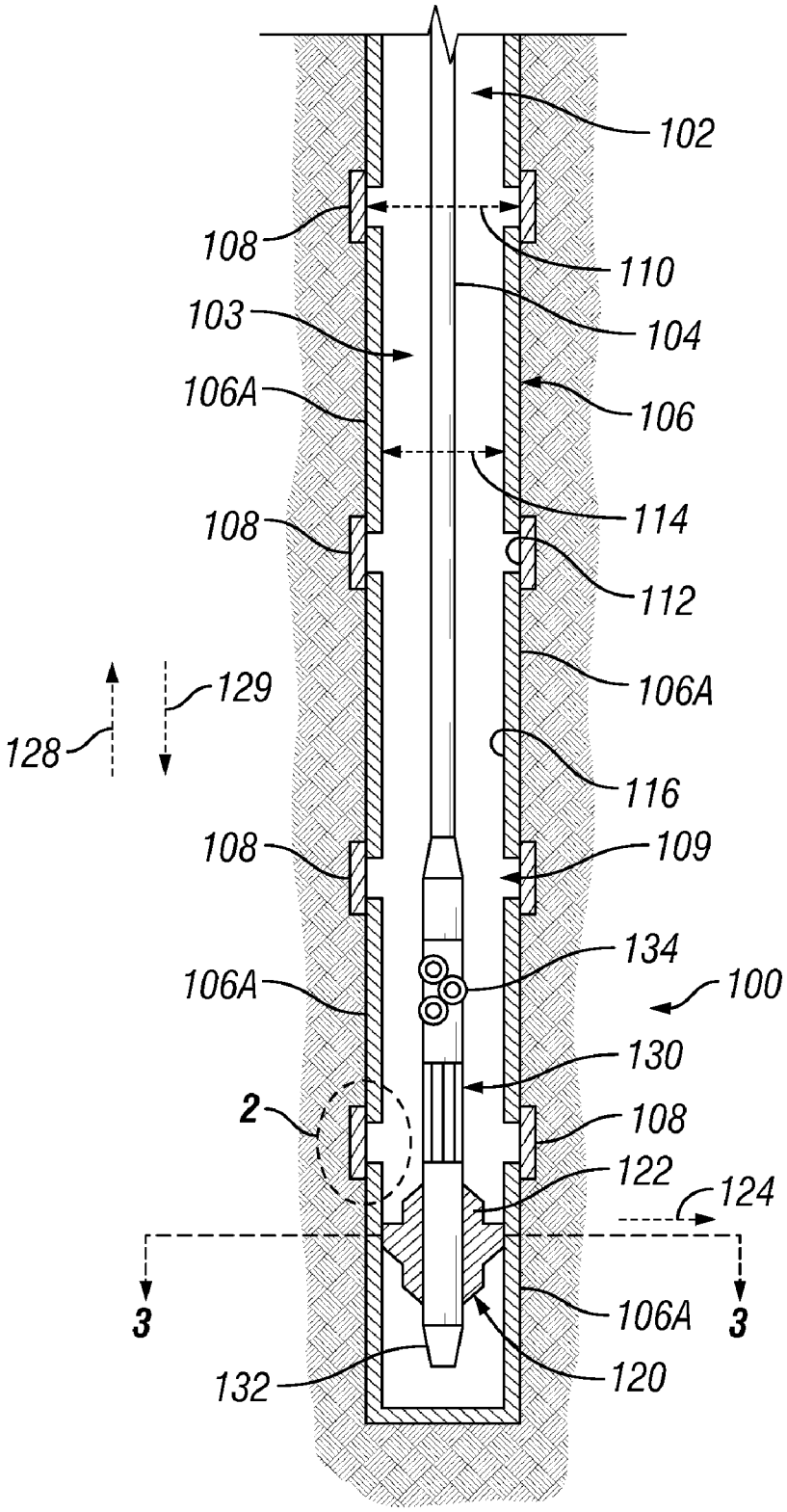
FIG. 1 is schematic partial cross sectional view of a bottom hole assembly within a cased wellbore.
Figure 2:
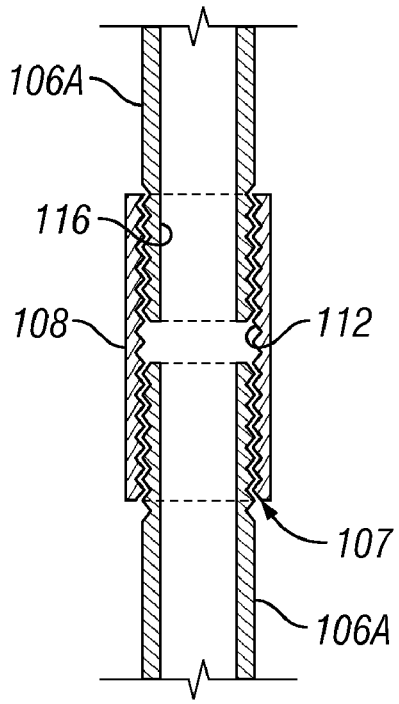
FIG. 2 is schematic partial cross sectional view of the encircled portion 2 of FIG. 1.
Figure 3:
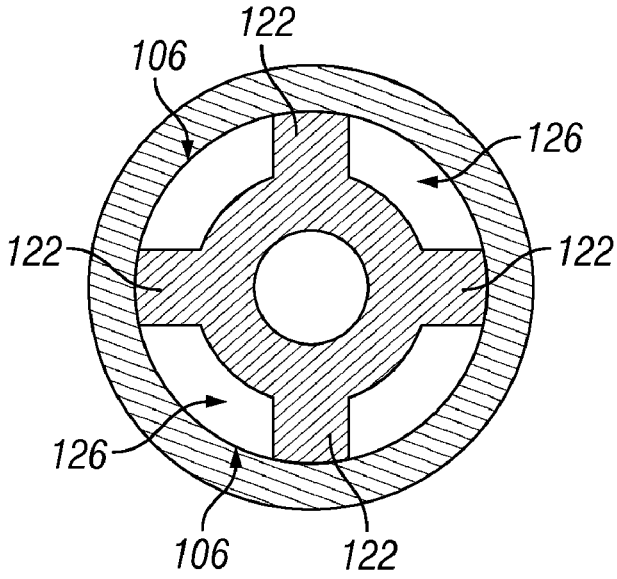
FIG. 3 is a schematic cross-sectional view taken along line 3-3 in FIG. 1.

Referring now to FIGS. 1-3, a downhole assembly or bottom hole assembly (BHA) is indicated generally at 100. The downhole assembly 100 is disposed in a wellbore 102 on a conveyance 104, such as coiled tubing, jointed pipe, drill pipe or the like extending from an oilfield surface (not shown) and is connected to suitable oilfield surface equipment (not shown). The wellbore 102 may be a cased wellbore having a casing 106 disposed therein. The casing 106 comprises a plurality of successive casing sections 106*a* joined by a corresponding plurality of collars 108, such as by threaded connections 107 or the like, as will be appreciated by those skilled in the art. Each of the collars 108 may define a recess 109 having an internal diameter 110 and an interior surface 112. The length of the diameter 110 has a greater length than the length of the nominal diameter 114 of the interior surface 116 of the casing 106 and casing sections 106*a*.

The downhole assembly 100 comprises a mechanical casing collar locator portion 120. The mechanical casing collar locator 120 comprises a plurality of engagement members 122 that engage with the interior surface 116 of the casing 106 and casing sections 106*a*. The engagement members 122 are biased by springs or the like to deflect substantially outwardly from the downhole assembly in a radially outward direction indicated by an arrow 124. When the downhole assembly 100 is moved (either in an uphole direction indicated by an arrow 128 or a downhole direction indicated by an arrow 129) such that the mechanical casing collar locator 120 is adjacent one of the collars 108, the engagement members 122 move in the direction 124 to engage with the interior surface 112 of the collars 108. The engagement members 122 define a plurality of circumferential passages 126 therebetween, which define a space between the mechanical casing collar locator 120 and the casing 106, best seen in FIG. 3. While illustrated in FIG. 3 as comprising four engagement members 122, those skilled in the art will appreciate that any suitable number of engagement members may be utilized.

The downhole assembly 100 may comprise a selective circulation valve 130 disposed above the mechanical casing collar locator 120 that is operable, in an open position, to allow fluid to flow from the interior of the coiled tubing 104 and out a cleaning nozzle 132 disposed at a free end of the downhole assembly 100. The cleaning nozzle 132 may be utilized to direct fluid therethrough generally in the direction 129 for a cleanout operation or the like. In a closed position, the selective circulation valve 130 prevents flow from the coiled tubing 104 to the cleaning nozzle 132. The circulation valve 130 may be cycled between the open position and the closed position by any suitable actuator or actuation method including, but not limited to, mechanical actuation by a pressure pulses, by pressure differential on a seat, by sequential direction changes in the directions 128 and 129 of the bottomhole assembly 100 that actuates an "on-off" mechanism such as by interacting J-slots or the like formed in the bottomhole assembly 100, as will be appreciated by those skilled in the art. The circulation valve 130 may be cycled by the utilizing the tension in the coiled tubing 104 when the engagement members 122 are deployed in the casing collar recess 109.

The downhole assembly or BHA 100 may also comprise at least one jetting nozzle or nozzles 134 disposed above the circulation valve 130. The jetting nozzles 134 are operable to emit a high velocity and or high pressure stream of fluid generally in the radially outward direction 124 from the interior of the coiled tubing 104 for perforating a casing section 106*a* or the like, as will be appreciated by those skilled in the art.

In an embodiment, the downhole assembly or BHA 100 is run into the wellbore 102 in the direction 129 on the coiled tubing 104 to the bottom of the cased wellbore 102 or to the last of the casing sections 106*a*. After reaching the bottom of the wellbore 102, the BHA 100 is pulled in the direction 128 to a location adjacent the first collar 108, which allows the engagement members 122 of the mechanical casing collar locator 120 to latch into the recess 109 of the casing collar 108. When disposed in the recess 109, the mechanical casing collar locator 120 requires additional pulling force to continue moving the BHA 100 in the direction 128. This force may be monitored by the surface equipment to alert an operator that the BHA 100 is disposed in the collar 108 and thereby provide the operator with an indication of the location of the BHA 100 within the wellbore. Each time the additional pulling force is noted, the force may be analyzed and matched to a casing collar profile to allow matching the casing collars 108 to the formation behind it for the purposes of depth determination and/or correlation of the zones of interest in the formation(s) with the casing 108. The casing collar profile is a standard log provided for an individual wellbore 102.

After the depth determination and/or correlation process is complete, the circulation valve 130 may be cycled and/or placed in the closed position. The circulation valve 130 may be cycled by moving the BHA 100 up and down in the directions 128 and 129 and utilizing the mechanical casing collar locator 120 as a friction device to mechanically actuate the circulation valve 130. The circulation valve 130 may be designed to be cycled or operated between open and closed positions by pumping fluids through the interior of the conveyance 104 such as coiled tubing, jointed pipe, drill pipe, or the like, or at certain rates and later stopping pumping and resume pumping, which would allow the circulation valve 130 to move between the open and close positions. The circulation valve 130 may be designed to be cycled or operated between open and closed positions by pumping fluids through an annulus 103 between the interior surface 116 of the casing 106 and an exterior surface of the coiled tubing 104 or at certain rates and later stopping pumping and resume pumping, which would allow the circulation valve 130 to move between the open and close positions. The circulation valve 130 may be operated by increasing and decreasing the pumping rates to allow the valve 130 to open or close at predetermined pumping rates and pressures.

Figure 7:
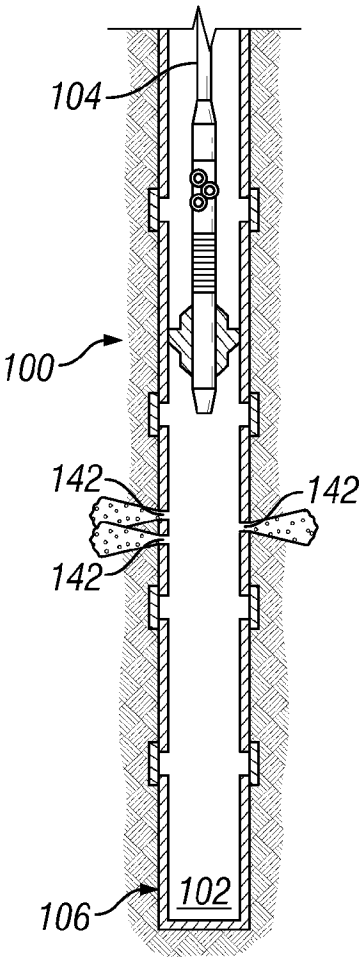
FIGS. 4-15 are schematic partial cross sectional views of a bottom hole assembly at various stages of operation within a cased wellbore.
Figure 6:
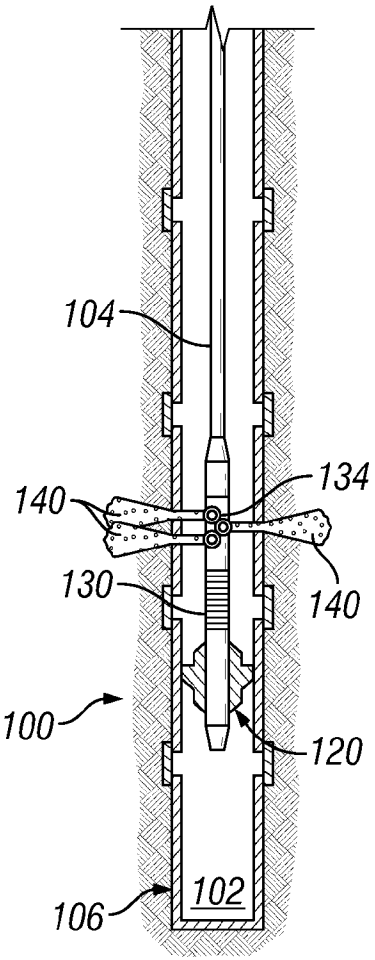
Figure 5:
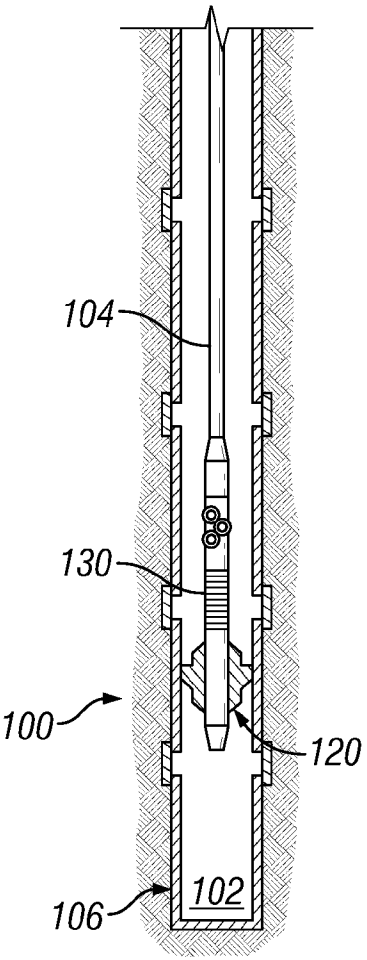
Figure 4:
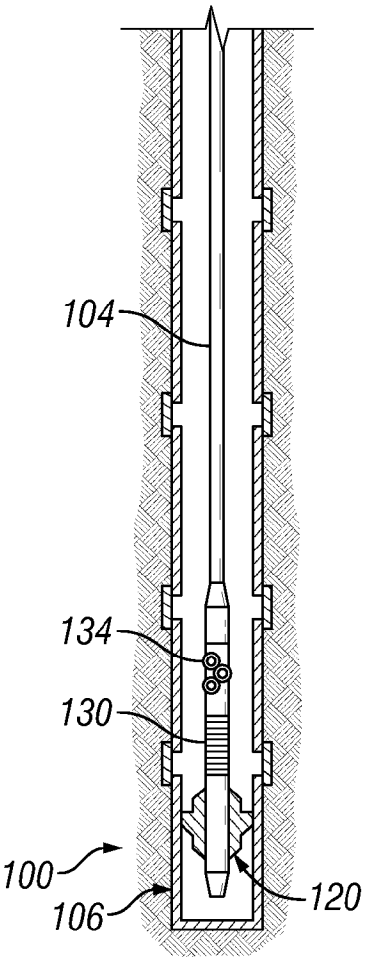

Referring now to FIGS. 4-15, the downhole assembly or BHA is shown in operation. In FIG. 4, the BHA 100 is run to the bottom of the cased wellbore 102 or to the last of the casing sections 106*a*. In FIG. 5, the BHA 100 is moved upwardly in the direction 128 to a desired location within the wellbore 102, based on the depth correlation information gathered and determined previously. In FIG. 6, fluid flows through the interior of the conveyance 104, such as coiled tubing, jointed pipe, or the like, and out through the jetting nozzles 134 with jets 140 to perforate the casing 106 at the desired location on the casing 106. The valve 120 is in the closed position in FIG. 6, to direct fluid flow to the nozzles 134 to form the jets 160. In FIG. 7, the fluid flow is stopped and the BHA 100 is moved upwardly in the direction 128 away from the newly formed perforations 142.

Figure 9:
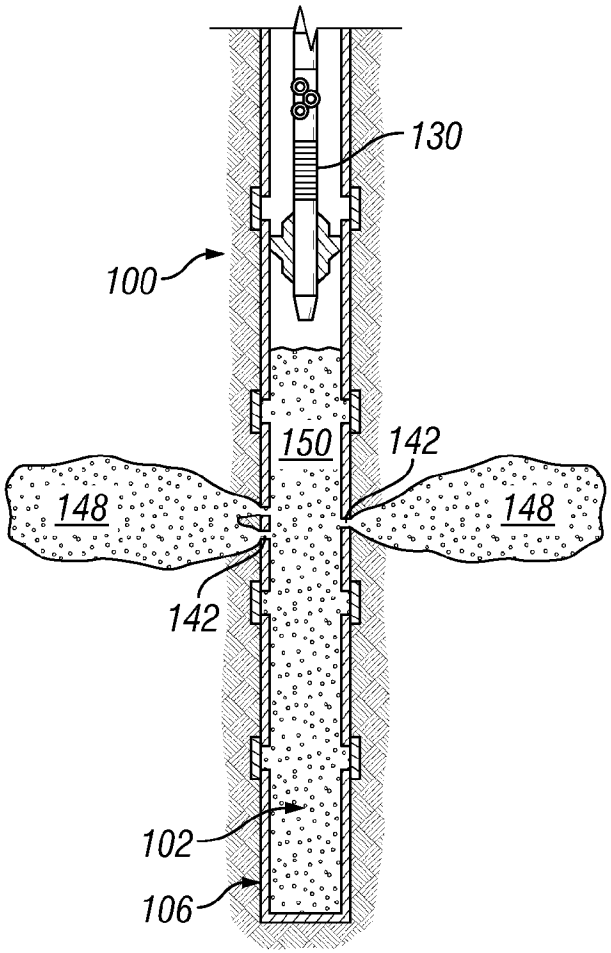
Figure 8:
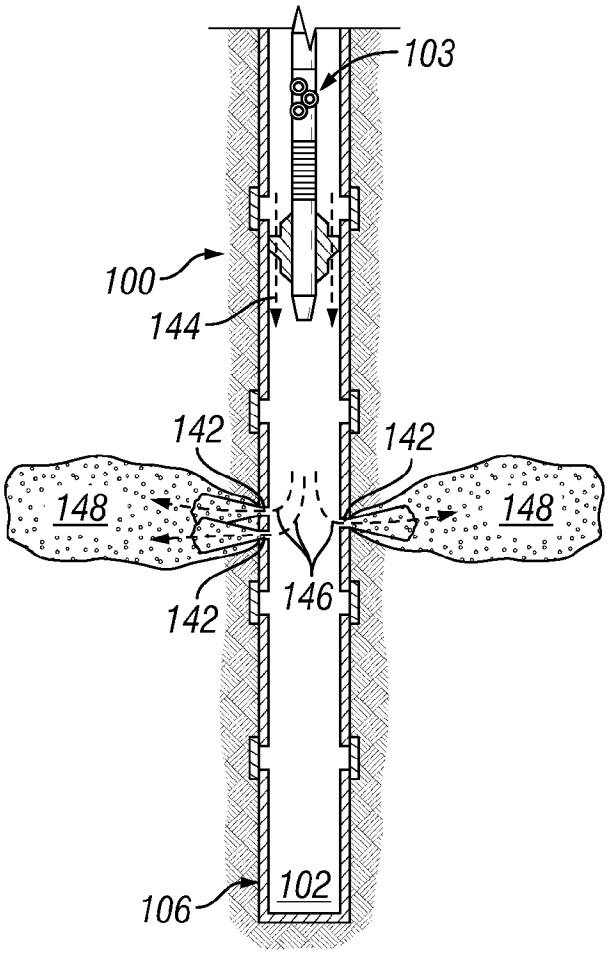
Figure 11:
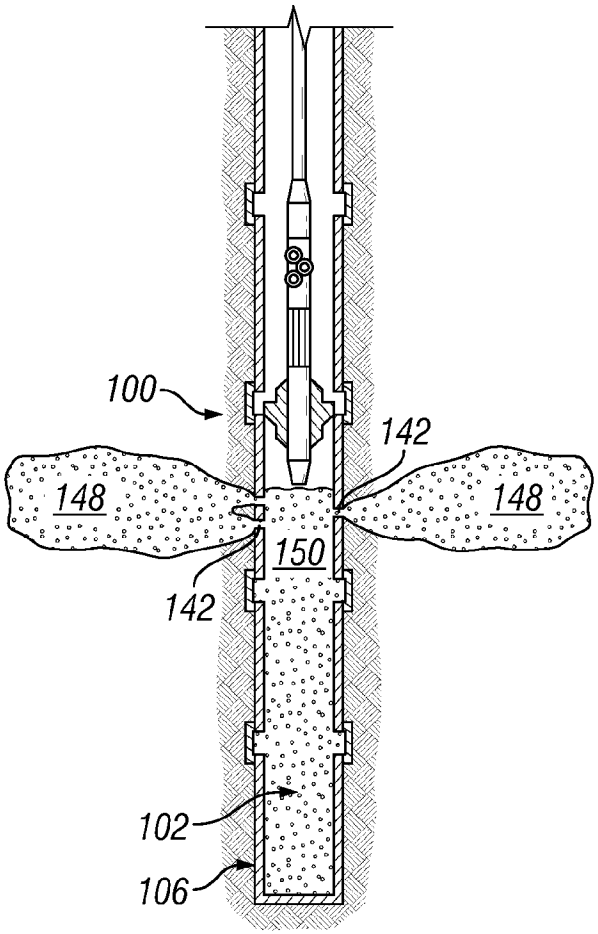
Figure 10:
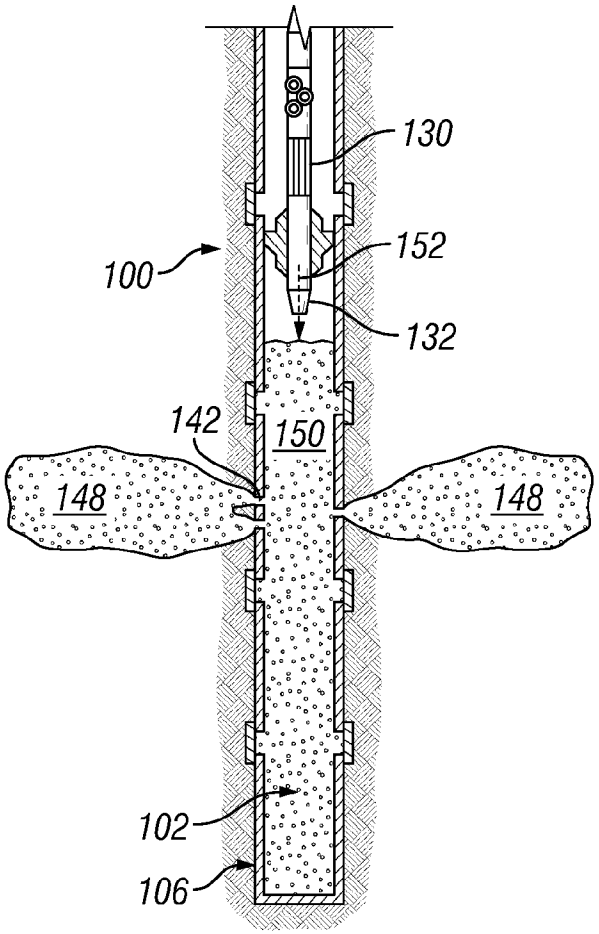

In FIG. 8, treatment fluid such as fracturing fluid or the like flows from the surface (pumped by fracturing pumps or other suitable surface equipment) through the annulus 103, past the BHA 100 and the mechanical casing collar locator 120 through the passages 126, as indicated by arrows 144, and through the perforations 142, as indicated by arrows 146, to form fractures in the formation adjacent the casing 106, indicated generally at 148. In FIG. 9, the treatment or fracturing is complete and sand-laden fluid is flowed through the conveyance 104, such as coiled tubing, jointed pipe, or the like, or along the annulus 103 to form a sand plug 150 in the borehole 102. In FIG. 10, the valve 130 is cycled from a closed position (as shown in FIG. 9) to an open position and fluid flows along the interior of the conveyance 104 and out the nozzle 132, as indicated by arrows 152 to clean out excess sand from the sand plug 150 to a level shown in FIG. 11 that is closer to the perforations 142. The excess sand may be removed by pumping the fluid entrained with the excess sand up the annulus 103 to the surface or by pumping the cleaning fluid down the annulus 103 and the fluid entrained with the excess sand up the conveyance 104 to the surface.

Figure 13:
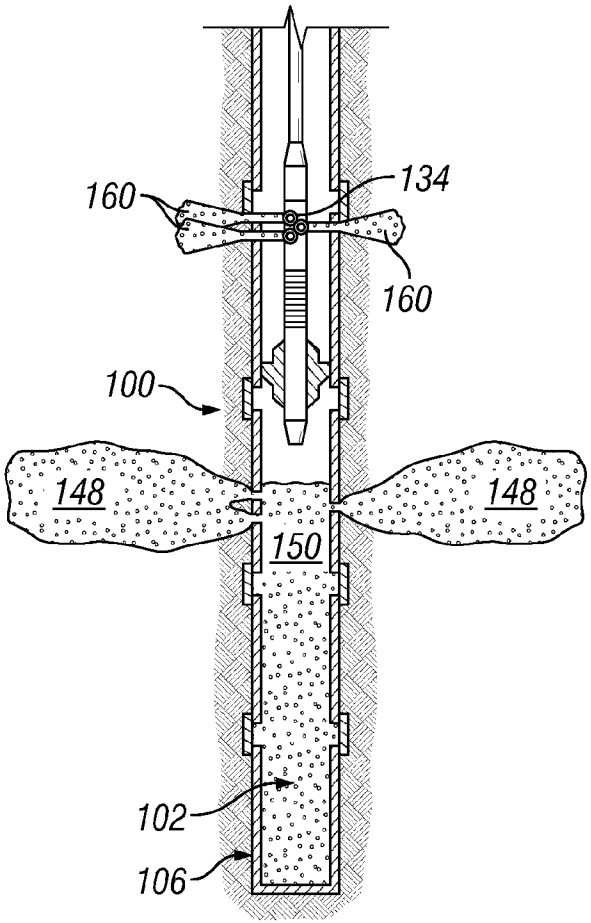
Figure 12:
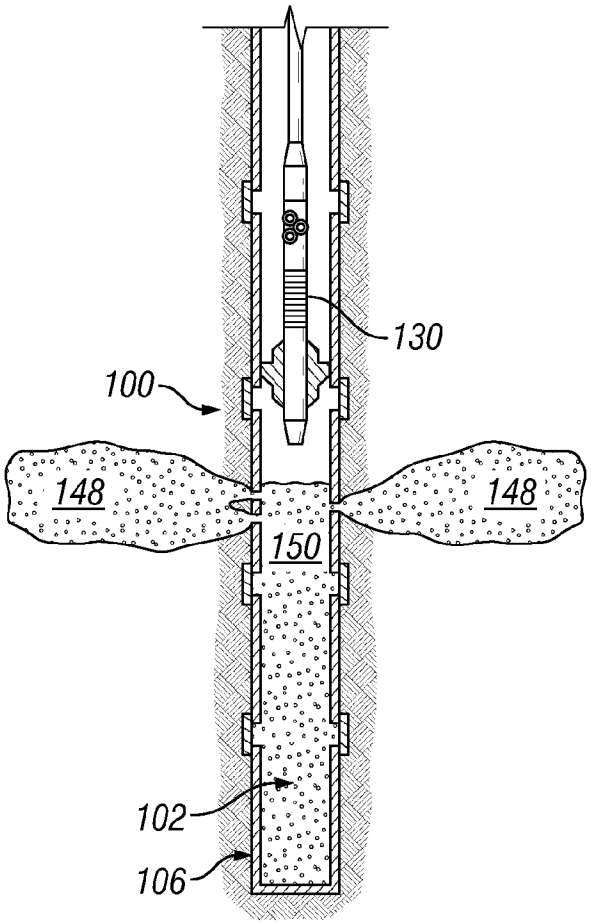
Figure 14:
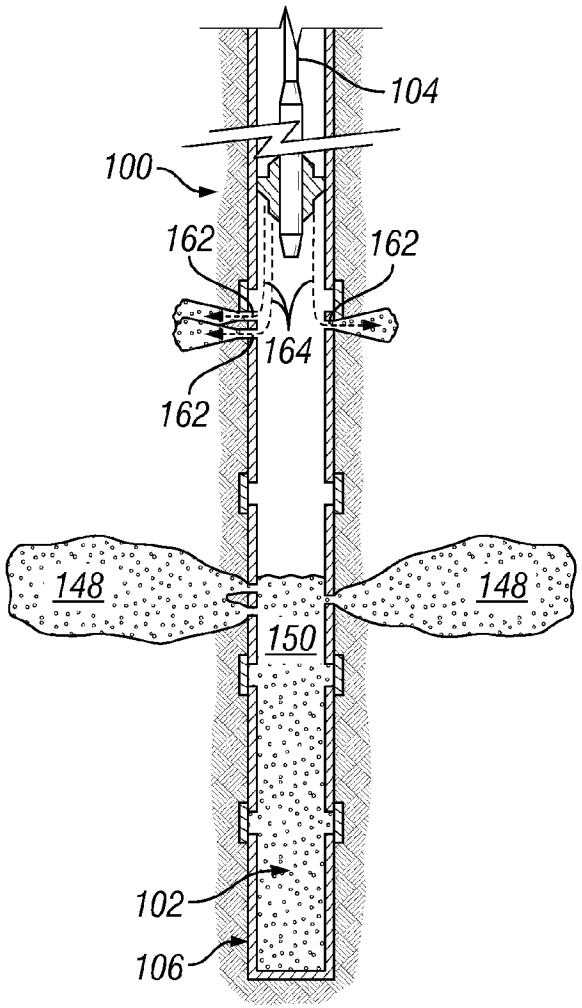

In FIG. 12, the BHA 100 is moved upwardly in the direction 128 to a desired location within the wellbore 102, based on the depth correlation information gathered and/or determined previously. In FIG. 13, fluid flows through the interior of the conveyance 104, such as coiled tubing, jointed pipe, or the like, and out through the jetting nozzles 134 with jets 160 to perforate the casing 106 at the desired location on the casing 106. The valve 120 is in the closed position in FIG. 13, to direct fluid flow to the nozzles 134 to form the jets 160. In FIG. 14, the fluid flow is stopped and the BHA 100 is moved upwardly in the direction 128 away from the newly formed perforations 162.

Figure 15:
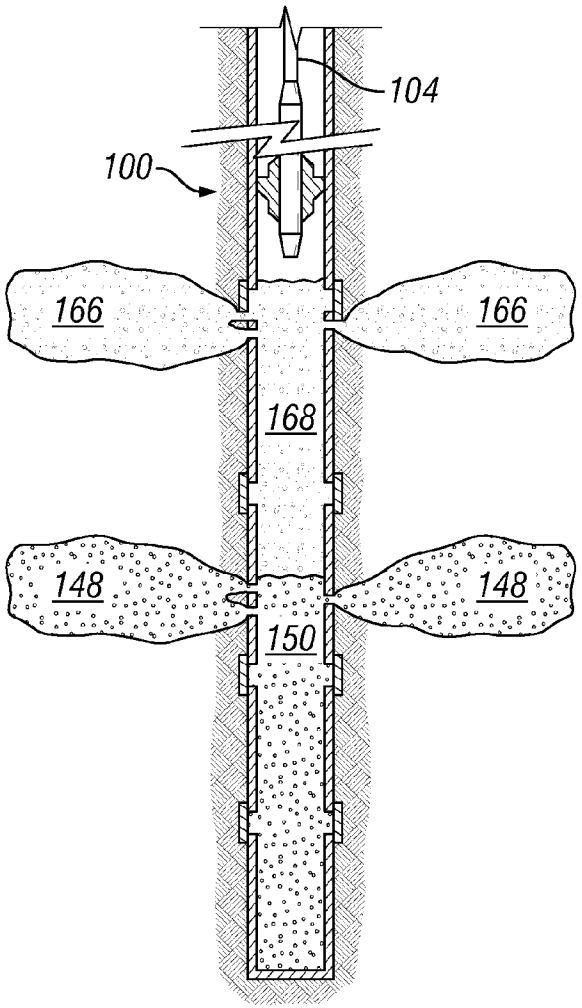

In FIG. 14, treatment fluid, such as fracturing fluid or the like, flows from the surface (pumped by fracturing pumps or other suitable surface equipment) through the annulus 103, past the BHA 100 and the mechanical casing collar locator 120 through the passages 126 (similar to that shown in FIG. 8) and through the perforations 162, as indicated by arrows 164, to form fractures in the formation adjacent the casing 106, indicated generally at 166. The sand plug 150 prevents flow down the wellbore 102 and assists in directing the treatment fluid to the perforations 162. In FIG. 15, the treatment or fracturing is complete and sand-laden fluid is flowed through the conveyance 104, such as coiled tubing, jointed pipe, or the like, or along the annulus 103 to form a sand plug 168 above the sand plug 150 in the borehole 102.

The BHA 100 may comprise both the mechanical casing collar locator 120 and the circulation valve 130. Alternatively, the BHA 100 may comprise only the mechanical casing collar locator 120 or only the circulation valve 130. Those skilled in the art will appreciate that the mechanical casing collar locator 120 and the circulation valve 130 may be used in conjunction with each other or independently, both to achieve better precision (utilizing the mechanical casing collar locator 120) and better efficiency (utilizing the circulation valve 130). Some operations may require only the mechanical casing collar locator 120, some operations will require only the circulation valve 130, and some will require both the mechanical casing collar locator 120 and the circulation valve 130.

In an embodiment, the downhole assembly or BHA 100 may be utilized to mechanically locate the casing collars 108 while being able to move the downhole assembly or BHA 100 up and down within the wellbore 102 while pumping treatment fluid, such as fracturing fluid. The downhole assembly or BHA 100 advantageously allows the bottom hole assembly to direct flow to the side ported abrasive jetting nozzles 134 or to the cleaning nozzle 132, which allows the BHA 100 to perform two functions. While jetting through the nozzles 134, the BHA 100 may jet a fluid (with or without gas) that may contain jetting sand or proppant for the purpose of forming abrasive jetting holes 142 and 162 through the casing 106, through cement (or even directly in an open hole wellbore and into the formation and across the zone of interest. The BHA 100, while circulating, may also be used for replacing the wellbore fluid with another fluid or gas, for cleaning out sand/proppant as in fill, plugs, debris, in a direct circulation manner wherein fluid or gas is pumped down the coiled tubing or jointed pipe 104 and returned on the annulus 103 between the coiled tubing 104 and tubing or casing 106 to return tanks or to any surface facility. The BHA may also be utilized for pumping fluid being pumped down the annulus 103 between the coiled tubing 104 and casing 106 and returned through the coiled tubing or jointed pipe 104 to the return tanks or any surface facility.

The downhole assembly or BHA 100 advantageously allows an operator to locate jetting locations based on determining the location of casing collars, such as the casing collars 108. The BHA 100 advantageously allows for the placement of multiple sand plugs and multiple fracturing stages at more precise locations based on the depth determination of the mechanical casing collar locator 120, without requiring tripping the coiled tubing out of the wellbore to replace the BHA 100 with another BHA that allowed that kind of circulation. The BHA 100 advantageously provides for depth control and for wellbore circulation in a single trip in the wellbore.

The preceding description has been presented with reference to presently preferred embodiments. Persons skilled in the art and technology to which these embodiments pertain will appreciate that alterations and changes in the described structures and methods of operation may be practiced without meaningfully departing from the principle, and scope of these embodiments. For example, embodiments depicted herein reveal a pressure pulse communication tool in the form of a multilateral tool. However, other embodiments of pressure pulse communication tools may be employed such as a casing collar locator tool. Furthermore, the foregoing description should not be read as pertaining only to the precise structures described and shown in the accompanying drawings, but rather should be read as consistent with and as support for the following claims, which are to have their fullest and fairest scope.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. In particular, every range of values (of the form, "from about a to about b," or, equivalently, "from approximately a to b," or, equivalently, "from approximately a-b") disclosed herein is to be understood as referring to the power set (the set of all subsets) of the respective range of values. Accordingly, the protection sought herein is as set forth in the claims below.

What is claimed is:

1. A method of performing a wellbore operation in an oilfield, comprising:

providing a bottom hole assembly on a conveyance;

deploying the bottom hole assembly into the wellbore with the conveyance;

determining the depth location of the bottomhole assembly in the wellbore utilizing a mechanical device;

moving the bottom hole assembly to a desired location based on the determined depth;

circulating a fluid from the oilfield to the bottomhole assembly; and performing at least one wellbore operation while the bottomhole assembly is deployed at the desired location, wherein performing at least one wellbore operation comprises circulating a treatment fluid through an annulus formed between the bottom hole assembly and the wellbore and past the mechanical device.

2. The method of claim 1 wherein providing comprises providing a bottom hole assembly on coiled tubing.

3. The method of claim 1 wherein providing comprises providing a bottom hole assembly on jointed pipe.

4. The method of claim 1 wherein providing further comprises providing a bottom hole assembly comprising a mechanical casing collar locator.

5. The method of claim 4 wherein determining the location comprises determining a depth in the wellbore by use of the mechanical casing collar locator.

6. The method of claim 5 wherein providing further comprises providing a bottom hole assembly comprising a circulation valve.

7. The method of claim 1 wherein providing further comprises providing a bottom hole assembly comprising a circulation valve.

8. The method of claim 1 wherein performing comprises forming a sand plug in the wellbore.

9. The method of claim 1 wherein performing comprises performing an abrasive jetting operation.

10. The method of claim 1 wherein circulating comprises actively selecting a flowpath of the pumped fluid through a plurality of flowpaths in the bottom hole assembly.

11. The method of claim 1 wherein circulating comprises circulating fluid from the oilfield past the bottomhole assembly.

12. A method of performing a wellbore operation, comprising:

providing a bottom hole assembly on a conveyance, the bottom hole assembly comprising a mechanical casing collar locator, a circulation valve, at least one jetting nozzle and a cleanout nozzle;

deploying the bottom hole assembly into the wellbore with the conveyance;

determining the depth location of the bottomhole assembly in the wellbore utilizing the mechanical casing collar locator;

moving the bottom hole assembly to a desired location based on the determined depth;

circulating a fluid from the oilfield to the bottomhole assembly; and performing at least one wellbore operation with the fluid while the bottomhole assembly is deployed at the desired location, the wellbore operation selected based on a position of the circulation valve.

13. The method of claim 12 wherein performing at least one wellbore operation comprises circulating a fracturing fluid at fracturing rates past the mechanical casing collar locator.

14. The method of claim 12 wherein performing comprises forming a sand plug in the wellbore.

15. The method of claim 12 wherein performing comprises performing an abrasive jetting operation.

16. The method of claim 12 wherein performing comprises performing a cleanout operation.

17. A bottom hole assembly for performing a wellbore operation, comprising:

a mechanical casing collar locator;

at least one letting nozzle for performing an abrasive jetting operation;

at least one cleaning nozzle for performing a cleanout operation; and a circulation valve operable to determine a flowpath to each of nozzles within the bottom hole assembly, the assembly operable to perform the abrasive jetting operation and the cleanout operation while the bottomhole assembly is deployed in the wellbore in a single trip operation.

18. The assembly of claim 17 wherein the assembly is deployed into a wellbore on coiled tubing.

19. The assembly of claim 17 wherein the mechanical casing collar locator is configured to allow treatment fluid to flow therepast.

* * * * *